US005351838A

United States Patent [19]

Flum

[11] Patent Number: 5,351,838

[45] Date of Patent: Oct. 4, 1994

[54] PRODUCT MERCHANDISING DISPLAY SHELF WITH FLEXIBLE GUIDE CHANNEL DIVIDER MEANS

[75] Inventor: Paul L. Flum, Ladue, Mo.

[73] Assignee: Paul Flum Ideas, Inc., St. Louis, Mo.

[21] Appl. No.: 87,670

[22] Filed: Jul. 7, 1993

[51] Int. Cl.[5] ..... A47F 1/04

[52] U.S. Cl. ..... 211/59.2; 211/153

[58] Field of Search ..... 211/59.2, 184, 153; 108/60

[56] References Cited

U.S. PATENT DOCUMENTS

| | | | |
|---|---|---|---|
| 3,484,226 | 12/1969 | Golightly | 211/184 X |
| 3,905,484 | 9/1975 | Dean et al. | 211/184 |
| 4,460,096 | 7/1984 | Ricci | 211/184 |
| 4,488,653 | 12/1984 | Belokin | 211/184 |
| 4,618,063 | 10/1986 | Mendenhall | 211/184 |
| 4,724,968 | 2/1988 | Wombacher | 211/184 X |
| 4,801,025 | 1/1989 | Flum et al. | 211/59.2 X |
| 4,942,968 | 7/1990 | Fast | 211/184 |
| 5,154,299 | 10/1992 | Hwang | 211/184 X |

*Primary Examiner*—Blair M. Johnson
*Attorney, Agent, or Firm*—Haverstock, Garrett & Roberts

[57] ABSTRACT

A shelf member for displaying and merchandising shelved products therefrom including front, rear and opposed side walls and a floor portion extending therebetween, a plurality of parallel upstanding divider wall portions defining therebetween a plurality of adjacent product channels for receiving and organizing products positioned therewithin in parallel rows, the divider wall portions as well as the shelf side walls being constructed so as to be not only sufficiently tall to provide the necessary lateral support for merchandising taller products within the respective product channels, but, importantly, being also sufficiently flexible and/or resilient so as to enable such taller products to move within the respective product channels without binding, squeezing or otherwise hindering the product flow, particularly in gravity feed applications. The present flexible guide channel divider walls can also be relatively easily retrofitted onto existing prior art shelf members.

18 Claims, 3 Drawing Sheets

PRODUCT MERCHANDISING DISPLAY SHELF WITH FLEXIBLE GUIDE CHANNEL DIVIDER MEANS

The present invention relates generally to product display devices for use in storing and merchandising shelved products therefrom and, more particularly, to various embodiments of an improved product merchandising display shelf structure having flexible or resilient product guide channel divider or partition means associated therewith, which divider means enable using the present shelf structure for merchandising and displaying relatively tall products therefrom such as the relatively new 20 oz. product containers presently being used by the soft drink industry. The present merchandising shelf member includes opposed side wall portions and a plurality of parallel upstanding divider or guide wall members defining therebetween a plurality of guide channels for receiving and organizing products positioned therein in parallel rows. The present flexible divider or guide wall means are associated with one or more of the side and guide wall members of the present unit or any other existing prior art unit and, importantly, they provide lateral support for taller products positioned in the respective guide channels so as to prevent such taller products from tipping or toppling over the respective side or channel divider wall means into adjacent products or channels as such products are removed therefrom. Also, importantly, the present divider means serve to guide and direct any movement of the products along the respective guide channels, and the flexibility of the present divider means enables smooth, free and unrestricted movement of the products within the guide channels without binding, squeezing or otherwise hindering the product flow, particularly in a gravity feed situation. This is true even in the event that the present shelf member sags or becomes somewhat twisted or bowed due to product weight, or due to the shelf member being unevenly loaded. The present shelf structure is primarily designed for use in a gravity feed orientation in a multitude of display shelf applications in supermarkets, convenience stores, and other food and beverage outlets, but is likewise adaptable for use in many other display shelf applications.

BACKGROUND OF THE INVENTION

A wide variety of display devices including shelves having guide members or other means forming channels for containing and guiding the movement of products thereon and therebetween have been designed and manufactured for use in merchandising shelved products to consumers. See, for example, the display units disclosed in Applicant's U.S. Pat. Nos. 4,801,025, 4,454,949 and 4,478,337. Changes in consumer tastes have caused an evolution towards taller product packages, especially taller soft drink containers, which taller containers tend to be more top-heavy and more unstable. A problem which has now been encountered with the known prior art display devices and, in particular, when merchandising products therefrom in a gravity feed application, is that such taller products now have a greater tendency to tip over the conventional guide channel wall means presently in use. This is particularly true because most of the prior art guide channel wall means were designed for accommodating and guiding the movement of shorter product containers. For instance, a recent shift in consumer demand towards taller 20 oz. individual single serve soft drink bottles from the prior used and shorter 12 oz. and 16 oz. bottles, and towards the taller 2 and 3 liter bottles from the smaller 1 liter bottles, has led to a greater incidence of the taller bottles tipping over the channel guide members and side walls of existing product merchandising units which were specifically designed for use with the smaller product containers. This is particularly true of the relatively new 20 oz. single serve petaloid bottle presently used in the soft drink industry since use of the petaloid bottom on a taller product container makes the taller container particularly unstable when sliding forward on track means within a particular guide channel in a gravity feed situation.

The above-discussed problem has led to increased product breakage and loss; it has lessened the attractiveness of the individual product displays; and it has required more frequent sorting and reorganizing of the shelved products. This problem has also been found to impede access to the products located on the shelf members and, as explained above, it greatly disrupts the free flow of the products in gravity feed applications. Taller products located on shelf members inclined for automatically gravity feeding the products to the front of the unit also present still another problem in that such taller products have a further tendency to also tip over the lower front wall construction of such prior art units, depending upon their particular construction.

Various means have been designed to alleviate the above-described problems associated with the prior art product merchandising display units, but all such means still suffer from certain disadvantages and shortcomings. In particular, many of such prior art guide channel divider means still provide a relatively low wall portion which is not of sufficient height to alleviate the aforementioned problems when merchandising the taller product containers. With respect to those prior art units which have provided taller divider walls or other divider means so as to contain and support the taller product containers to prevent them from tipping over, such taller divider means are of a rigid construction and such rigid taller divider means extend uninterrupted the full length, or at least a substantial portion of the full length, of the particular unit between its front and rear wall portions. Since the shelf members with which such prior art taller divider means are used are generally of a molded plastic construction, such units have a tendency to deflect or sag towards their center when fully loaded. This causes the uninterrupted rigid taller divider wall members to twist, bend or otherwise deform when such units are fully loaded, unevenly loaded, or insufficiently supported. This can result in what is known as "fish-tailing" which is the bowing or warping of the divider wall portions or other guide channel wall means whereby portions of the divider walls extend into the respective guide channels and interfere with the flow of products along and through such guide channels by pushing against and binding or squeezing the product containers positioned therewithin. This prevents the free movement of such product containers within such guide channels, particularly, in a gravity feed application. This is also particularly problematic in regard to shelf members used and supported as the upper tiers of multiple tier product merchandising displays. Taller products are also generally heavier than the shorter products and their additional product weight likewise contributes to the sagging and deformation of the shelf members.

Various prior art means intended to address the tendency of the taller product containers to tip over the lower front edge portion of prior art units when inclined in a gravity feed orientation also suffer from certain disadvantages and shortcomings. In particular, shelf members used in a gravity feed application typically include an opening provided through the front wall of the shelf member adjacent each respective guide channel to enable both product visibility and accessibility from each particular guide channel. The prior art means attempt to prevent products from accidentally falling or tipping forward through these front wall openings by using a wide variety of front wall means, particularly additional wire means, which bridge or cross these openings. However, these additional front wall stop means typically also obstruct access to the respective guide channels and make the products positioned therewithin more difficult to remove therefrom. These additional stop means also tend to cover the product labels and other signage on the products which often times is unacceptable to merchandisers. For these and other reasons, these solutions to the above-described problems have enjoyed only limited success.

SUMMARY OF THE INVENTION

The present invention overcomes many of the disadvantages and shortcomings associated with known shelf constructions for product merchandising display devices, and teaches the construction and operation of several embodiments of an improved product merchandising shelf member which is capable of containing and guiding the movement of relatively tall products, such as the relatively new 20 oz. petaloid soft drink container as well as 2 and 3 liter soft drink containers and the like, in a plurality parallel rows. The present shelf member is adapted to be supported in either a horizontal orientation, or in an inclined orientation for gravity feeding products positioned thereon, and the present shelf construction is particularly well suited for use in product merchandising display units for merchandising and displaying a wide variety of products such as soft drinks, juices, dairy products and so forth in supermarkets, convenience stores and the like, as well as in a wide variety of other product merchandising and storage applications. The teachings of the present invention can be incorporated in a variety of new product merchandising shelf designs, and can also be adapted for retrofitting a wide variety of different existing shelf member constructions.

The present shelf member is preferably of a molded plastic construction having opposed front and rear walls, opposed side walls, and a floor portion extending therebetween, the present shelf member further including a plurality of parallel guide members or divider walls extending between the front and rear wall portions thereof defining a plurality of parallel adjacent guide channels for receiving and guiding products positioned therein in parallel rows. A track portion is preferably formed adjacent the floor portion in each guide channel for improving the slidability of products positioned thereon. Also, preferably, the front wall portion of the shelf member is shaped so as to form a plurality of inverted arches, each inverted arch being positioned respectively adjacent the front edge portion of each respective guide channel and each serves as a forward stop means for holding and retaining products positioned within the respective channels until such products are removed therefrom. The side wall or leg portions of the inverted arches may be dimensioned and constructed such that they provide additional support for the opposed side portions of the forwardmost product positioned in each respective guide channel along at least a portion of the full height of each inverted arch leg portion thereby substantially preventing the taller product containers from toppling forward out of the unit. It is also recognized that other front wall designs could likewise be utilized to achieve the stated objective without sacrificing product visibility and accessibility.

The present flexible guide channel divider means are preferably integrally formed with the opposed side wall portions and the channel guide means of the present shelf member and provide additional supplemental lateral support for taller product containers positioned and located in the respective guide channels. The present flexible divider or guide means extend upwardly from the floor portion of the present shelf member along at least a substantial portion of the length between the front and rear wall portions thereof and are positioned so as to engage the upper portion of any product container which may tip or lean sidewardly to prevent such product from toppling over the side of the present shelf member or over any of the respective channel guide members into an adjacent guide channel or into contact with other products located therein. The present divider means also serve to guide and contain any movement of the products along the respective guide channels when the shelf member is inclined for gravity feed operations and when products are being removed therefrom or being restocked.

Each of the present flexible guide or divider means is of a substantially planar construction and, importantly, each is relatively thin in thickness so as to be flexible and/or resilient. The present planar guide member also importantly includes one or more slots or notches located at spaced locations along the full length thereof, each slot or notch extending in a vertical orientation, either partially or completely, from the top to the bottom edge portion of each guide member. Unlike the prior art guide or divider means which are unslotted, and which are more rigid and tend to warp, bow and/or "fish-tail", the slotted flexible divider or guide wall means of the present invention closely follow the shape of the respective side walls or guide members in the event the shelf member sags or twists for any reason such as when heavily loaded or inadequately supported. This is true because the plurality of slots associated with each of the present guide members segregates the present guide members into a plurality of shorter segmented portions each capable of flexing due to the thinness and resiliency of each member. The present slots ensure free movement of products along each respective guide channel without being pinched, squeezed or otherwise engaged or restrained by the present guide channel means even when the present shelf member is fully loaded, unevenly loaded, or is supported as an upper tier of a multiple tier display unit as will be hereinafter further explained.

The size and shape of the present guide means can also be adapted to meet the requirements of any particular merchandising or storage application. For instance, the present guide means can extend along all or any portion of the full length or depth of the unit, and they can extend upwardly therefrom to any desired height sufficiently to support and guide product containers of any particular height so as to substantially prevent such product containers from toppling over the channel guide means. The present guide means can also include any number of slots or spaces formed therein, which slots or spaces can be formed at any angular orientation relative to the floor of the unit or the horizontal plane, and the present guide means can be of any suitable-width so as to provide the necessary flexibility to each segmented portion required for a particular application. Additionally, although the present guide means can be integrally incorporated into a wide variety of new and existing product merchandising shelf designs, they can also be relatively easily retrofitted onto existing prior art shelf constructions. For instance, to retrofit an existing shelf with the present divider means, the present channel guide members can be adhesively or otherwise attached to the respective side walls and guide members of an existing shelf member so as to extend upwardly therefrom to the desired height. The present guide members can be attached to the respective side walls and divider members of such prior art units adjacent the respective top edge portion thereof, or alternatively, they can be attached to one side thereof. When attached to one side of the respective side walls and divider members of an existing unit, the present guide members are preferably attached such that no one guide channel includes more than one of the present guide members. This arrangement will help to maintain the width of each respective guide channel at approximately its original width, each retrofitted guide channel being reduced in width by the thickness of the present guide means extending therewithin.

The present shelf member construction and the present flexible guide means can additionally include frangible means enabling one or more rear end portions thereof to be separated and/or broken off so as to fit a particular display application. The present product merchandising shelf can also include optional support means associated with the front wall portion thereof to prevent taller products from falling forward out of the unit, which optional front wall support means are particularly useful for gravity feed applications. The present optional front wall support means can also be made transparent so that product labeling and marking can be easily viewed therethrough and such support means can likewise be easily retrofitted into existing units.

It is therefore a principal object of the present invention to provide a product merchandising display shelf construction which can attractively organize and merchandise therefrom a plurality of relatively tall product containers positioned thereon in convenient parallel rows for easy access and removal.

Another object is to provide a product merchandising display shelf construction having means associated therewith enabling continuous free movement of a plurality of relatively tall products positioned thereon in organized parallel rows when such shelf member is inclined in a gravity feed orientation.

Another object is to provide product guide means which do not bind or otherwise interfere with the free movement of products within the respective guide channels of a product merchandising display device.

Another object is to provide a product merchandising shelf construction for storing and merchandising relatively tall products therefrom which is relatively inexpensive to manufacture.

Another object is to provide flexible guide channel divider means for product merchandising shelf members which can be either integrally formed into the shelf member, or alternatively, can be easily retrofitted onto an existing shelf member.

Another object is to provide a product merchandising shelf structure including means for preventing taller products located thereon from toppling over the front wall of the shelf structure and which means do not interfere with product accessibility and/or visibility.

These and other objects and advantages of the present invention will become apparent to those skilled in the art after considering the following detailed specification of several preferred embodiments of the subject device in conjunction with the accompanying drawings wherein:

DETAILED DESCRIPTION OF THE PREFERRED EMBODIMENTS

Figure 1:
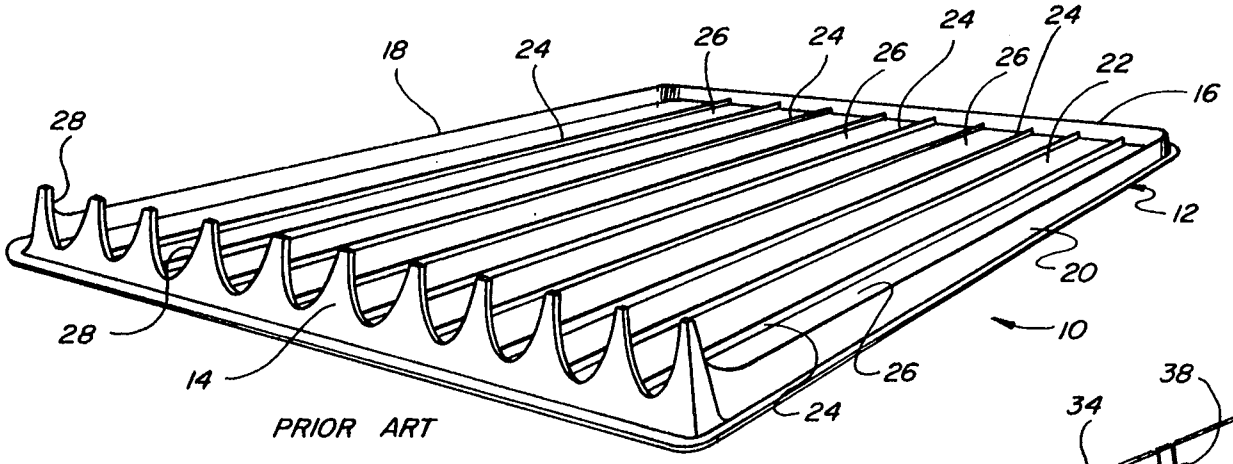
FIG. 1 is a perspective view of a prior art product merchandising shelf member which suffers from many of the shortcomings and limitations described above when used to merchandise taller products therefrom.

Referring to the drawings more particularly by reference numbers wherein like numerals refer to like parts, number 10 in FIG. 1 identifies a typical prior art product merchandising display unit such as, for example, one of the shelf members disclosed in U.S. Pat. No. 4,801;025. The shelving unit 10 is designed to support and merchandise products positioned thereon such as bottled and canned soft drink products and the like and can be supported in both a horizontal or flat orientation and, alternatively, in an inclined orientation for gravity feeding products located thereon.

The prior art shelving unit 10 includes a generally rectangular base shelf structure 12 adapted for use on a support structure (not shown) such as shelving support structures commonly employed by a wide variety of food and beverage outlets including shelving associated with conventional refrigerated display coolers and other types of cold vaults. The shelf structure 12 includes spaced front and rear edges or walls 14 and 16, spaced side edges or walls 18 and 20, and a floor portion 22 which extends substantially the full length and width of the base shelf structure 12 between the front, rear and side walls thereof. A plurality of spaced upstanding divider wall portions or guide members 24 extend uninterrupted the entire length of the shelf structure 12 between the front and rear walls 14 and 16 and define therebetween a plurality of parallel guide channels 26 for supporting and guiding products positioned therein in parallel rows. Each of the guide channels 26 is also defined by a portion of the floor 22 located between adjacent divider walls 24. The divider walls 24, importantly, are relatively short in height and are shown integrally formed with the structure 12 for ease of manufacture and to lend strength and stability to the overall shelving unit 10, although other suitable means may be used to attach the divider walls 24 to the structure 12. Furthermore, the shelf front wall 14 is shaped so as to form a plurality of inverted arches 28 defining a plurality of openings therethrough, each inverted arch 28 being positioned respectively adjacent the front edge portion of each respective guide channel 26. The inverted arches 28 serve as a forward stop means for holding and retaining products positioned within the respective guide channels 26 until such products are removed therefrom. It is recognized that a wide variety of other front wall shapes and designs as well as a wide variety of other suitable forms of stop means are utilized across the front portion of existing prior art units so as to hold and retain products positioned thereon in both a gravity feed orientation as well as in a flat, horizontal orientation.

The prior art product merchandising display unit 10 described above, as well as other prior art shelving unit constructions, suffer from many of the problems discussed above when it comes to merchandising the taller product containers presently being utilized in the marketplace such as the taller 20 oz. single serve soft drink containers discussed above. In other words, the lower divider walls 24 as well as the lower shelf side walls 18 and 20, which wall members are representative of many of the existing prior art display shelf constructions presently in use, provide inadequate lateral support and guidance for relatively tall product containers positioned therebetween so that such taller products can easily tip over the side edge of such prior art display units or into adjacent product guide channels as previously discussed above. The present product merchandising shelf construction includes product channel guide means which are specifically directed to containing and guiding the movement of relatively tall product containers positioned thereon, including the newer 20 oz. petaloid soft drink container as well as 2 and 3 liter soft drink containers.

Figure 2:
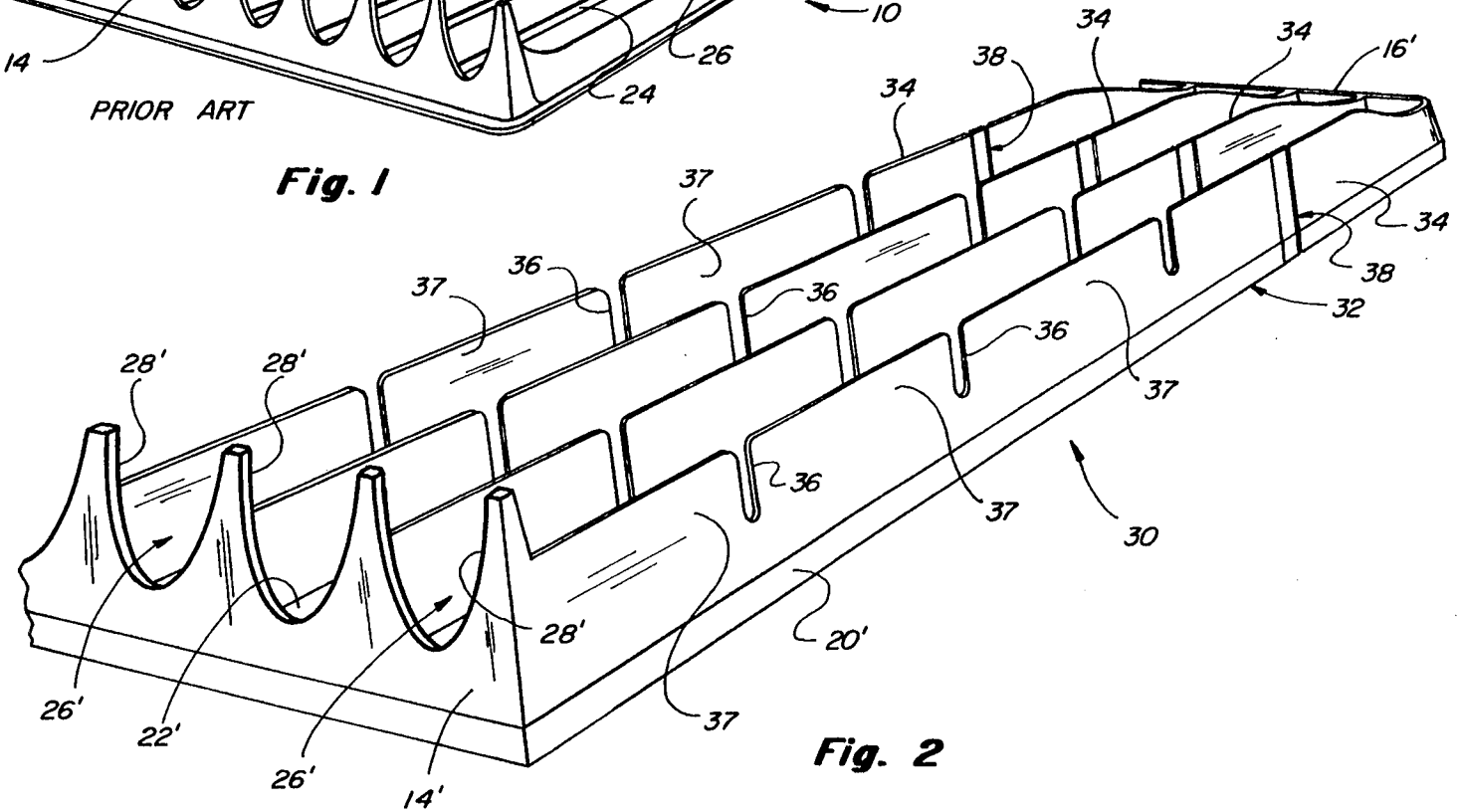
FIG. 2 is a fragmentary perspective view of a product merchandising shelf member constructed according to the teachings of the present invention showing the present flexible guide channel means associated therewith.

FIG. 2 illustrates one embodiment of a product merchandising display shelf unit 30 incorporating the teachings of the present invention. The present shelf unit 30 includes a generally rectangular shelf structure 32 which can be fabricated from molested plastic or other suitable materials and which can be dimensioned in a multiple of different sizes so as to be adapted for use on the same support structures presently being utilized in a wide variety of food and beverage outlets including use in refrigerated display coolers and the like. It is intended that the present shelf unit 30 be used either as a replacement for existing prior art units or it can be mixed and matched with the prior art units in various merchandising applications. The present base shelf structure 32, like the prior art base shelf structure 12, includes spaced front and rear edges or walls 14' and 16', spaced side edges or side walls 18' (not shown) and 20', and a floor portion 22' which extends substantially the full length and width of the base shelf structure 32 between the front, rear and opposed side walls. The present shelf structure 32 also includes a plurality of parallel guide channels 26' for receiving and holding products, and a plurality of inverted arches or other shaped openings 28' formed in channels 26' substantially similar to the construction of shelf memer 10.

Figure 3:
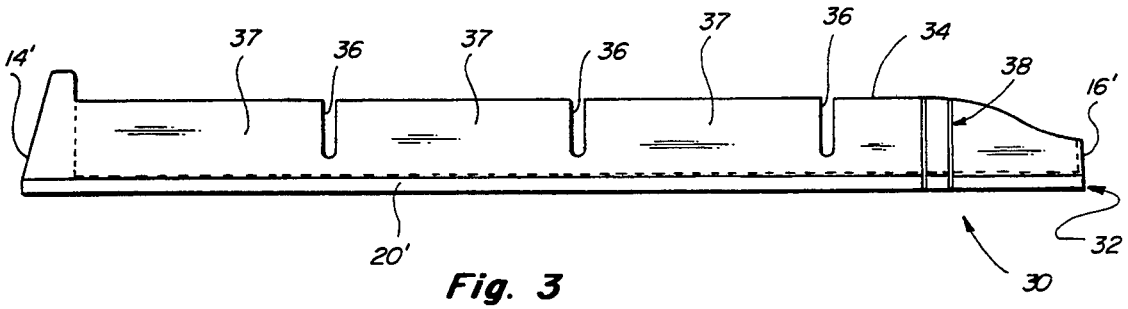
FIG. 3 is a reduced side elevational view of the product merchandising shelf member of FIG. 2.

The guide channels 26' of the present shelf structure 32 are formed by flexible or resilient channel guide or divider means which provide the capability of containing and guiding the movement of taller product containers positioned therebetween. Referring to FIGS. 2 and 3, the present guide means include guide members 34 which are substantially planar in construction and which are formed relatively thin in thickness so as to be relatively flexible and/or resilient as will be hereinafter further explained. Importantly, the present guide members 34 include one or more slots or notches 36 positioned and located at spaced locations intermediate the front and rear wall portions of the shelf structure 32 as shown in FIGS. 2 and 3. Each slot or notch 36 extends in a vertical direction part way along the full height of each guide member 34 (FIGS. 2 and 3) so as to segregate each guide member 34 into a plurality of segmented portions 37. It is also recognized that the segmented portions 37 may be formed by allowing each slot or notch 36 to likewise extend either completely or substantially the full height of each guide member 34 from the top edge portion thereof to adjacent the floor portion 22, if so desired. Each segmented guide portion 37, no matter how formed, is capable of flexing and/or bending due to the thinness and resiliency of each of the guide members 34 and, importantly, due to the spaced positioning of the slots or notches 36. This means that even if the present shelf member 30 is allowed to sag or bow towards its center for whatever reason as previously explained, the segmented guide portions 37 will not prohibit or restrict the movement of product containers positioned therebetween even if such divider means extend into the respective product channels. This is true because the present slot arrangement allows each segmented portion 37 to flex and bend sidewardly away from the product containers as such product containers move therebetween from the rear of the shelf unit towards the front thereof. Use of the present slot means 36 provides sufficient flexibility to each respective segmented guide portion 37 so as to allow each of the segmented guide portions 37 to closely follow and flex with the shape of the product containers as they move therebetween if such guide channel portions do in fact come into contact with the product containers for whatever reason. This particular guide channel wall construction provides a mechanism for substantially eliminating any binding or squeezing of the product containers by the channel guide walls as such containers move therebetween and such construction ensures free movement of such products between the present slotted or notched guide members 34 in a gravity feed situation or otherwise.

Also, importantly, unlike the prior art divider wall portions 24, since the present guide members 34 are considerably higher or taller in height as compared to the divider wall members 24, the present guide members 34 also provide sufficient lateral and sideward support for the taller product containers positioned in the respective guide channels 26' thereby further substantially preventing such product containers from tipping or toppling over the sides of the shelf member 30 or into adjacent product rows. Furthermore, in gravity feed applications and when the present shelf members 30 are being restocked or re-organized, the present guide members 34 provide flexible and resilient sideward support for guiding the movement of the products along the respective guide channels 26' without binding or otherwise interfering with such products as previously explained, even when the base shelf structure 32 sags or is somewhat twisted due to heavy or uneven product loading, or any other reason which may cause the present shelf member 30 to sag, bow or otherwise deform.

The flexible guide members 34 can be sized and shaped for use with a wide variety of product containers and for any particular merchandising or storage application. Also, although the present slots 36 are shown in a substantially vertical orientation relative to the horizontal, it is recognized and anticipated that the slots 36 can be formed at any angular orientation to the horizontal or vertical so long as the respective segmented guide portions 37 can flex and/or bend sidewardly as previously explained to allow free movement of products therebetween. The present guide members 34, as well as the base shelf structure 32, can also optionally include frangible means such as the frangible means 38 illustrated in FIGS. 2 and 3 to enable breaking off one or more rear end portions of the structure 32 as is true of some prior art constructions to conform the present shelf member 30 with size constrictions for a particular application. Also, the guide members 34 can likewise be formed so as to stop short of any frangible means associated with a particular base shelf structure so as not to interfere with the severing of any rear shelf portions similar to the retrofit embodiment of the present guide members discussed below and illustrated in FIG. 5.

Although the present guide members 34 are preferably integrally formed into a new shelf member such as the present shelf member 30, the present channel guide means can likewise be provided separately or in kit form for retrofitting existing shelving units to enable such prior art units, such as the shelving unit 10 illustrated in FIG. 1, to efficiently handle the taller product containers, particularly in a gravity feed operation. Referring to the FIGS. 4 and 5, a plurality of individual guide members 40 constructed according to the teachings of the present invention are shown installed on a prior art shelving unit such as the prior art unit 10 illustrated in FIG. 1. The retrofit guide members 40 are substantially identical in construction to the guide members 34 (FIGS. 2 and 3) and each is of a relatively thin, flexible/resilient construction, and each importantly includes a plurality of slots or notches 36' formed therein defining a plurality of segmented portions 37' as previously described with respect to the guide members 34. The retrofit guide members 40 can be easily installed on any existing prior art unit by using any suitable means such as suitable adhesives or other bonding agents, or a wide variety of suitable mechanical fastening means. In the present instance, the retrofit guide members 40 are shown adhesively bonded to one side portion of the prior art unit side wall 20 as well as to one side portion of the plurality of existing divider walls 24, each retrofit guide member 40 being attached such that each guide channel 26 includes only one such guide member 40 located specifically therewithin, yet each channel 26 includes a guide member 40 on each respective side thereof is also recognized that the guide members 40 can likewise be constructed so as to straddle or otherwise engage the top edge portion of each divider wall 24. Other attachment arrangements are likewise contemplated.

Figure 4:
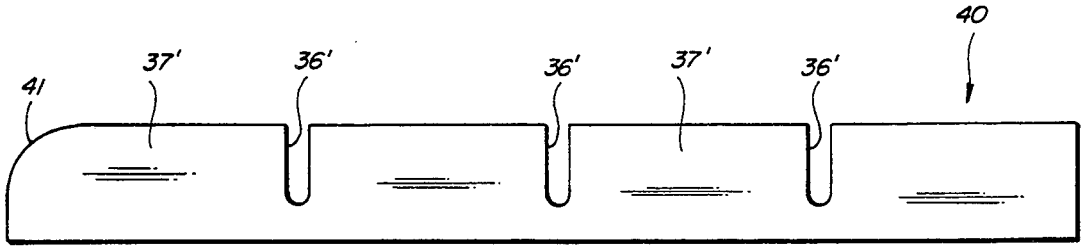
FIG. 4 is a side elevational view of another embodiment of the present guide channel means specifically designed for use in retrofitting existing prior art shelf members.
Figure 5:
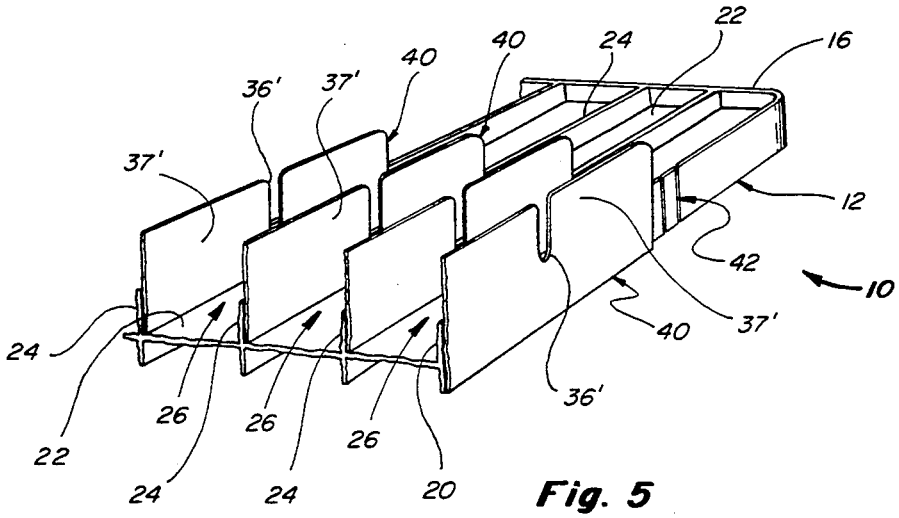
FIG. 5 is a fragmentary perspective view of a prior art shelf member similar to that shown in FIG. 1 showing the present guide channel means of FIG. 4 retrofitted onto a prior art shelf member.

The retrofit guide members 40 function and operate substantially similar to the members 34 and they provide both the necessary lateral support for the taller product containers and the necessary resiliency to ensure free product movement along the respective guide channels 26. Also, the retrofit guide members 40 can be of any size and shape required for a particular application, and they can be of any suitable length. For example, the guide members 40 as shown in FIG. 5 are somewhat shorter in length than the overall depth of the base structure 12 so as to enable using existing frangible means such as the frangible means 42 which may be incorporated into the shelf structure 12 for shortening the shelf depth, if required. The retrofit guide members 40 can also include frangible means incorporated directly thereon (not shown) as discussed above in reference to the guide members 34 illustrated in FIGS. 2 and 3. It is also recognized and anticipated that the front portion 41 of each retrofit guide member 40 as best shown in FIG. 4 can likewise be shaped and dimensioned so as to conform and mate with the front wall or edge portion of the particular prior art unit being retrofitted.

Still further, it is recognized and anticipated that each segmented portion 37' can also be formed as a separate, individual member. In this particular arrangement, each guide member 40 will be comprised of a plurality of individual guide portions 37', each plurality of individual guide portions 37' being attachable to a particular sidewall and/or divider wall of an existing prior art unit in spaced apart relation to an adjacent guide portion 37' Although this particular arrangement of individual members 37' may be somewhat cumbersome to install on an existing unit, such an arrangement would likewise provide both the necessary lateral support for taller product containers and the necessary flexibility or resiliency to ensure free product movement along the respective guide channels in a particular unit.

Figure 6:
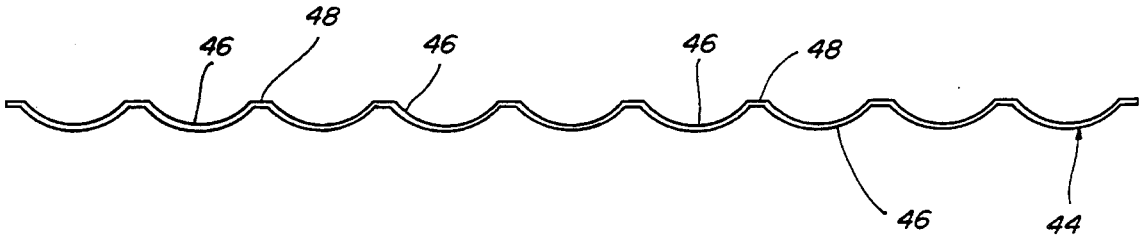
FIG. 6 is a top plan view of optional stop means for supporting and preventing products from toppling over the front wall of a product merchandising shelf member.
Figure 7:
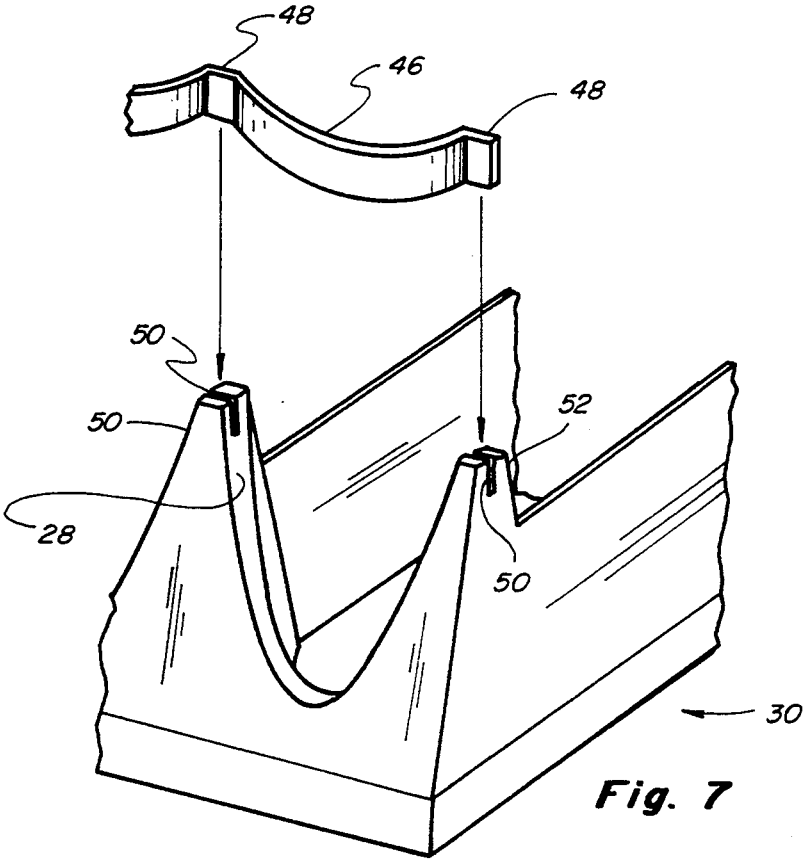
FIG. 7 is a fragmentary perspective view showing the stop means of FIG. 6 in association with a particular shelf member.

Although each inverted arch 28' associated with the present shelf member 30 is preferably constructed such that the respective leg portions thereof are dimensioned sufficiently high enough to provide additional support to the forwardmost taller product containers positioned adjacent thereto in each respective guide channel 26' so as to prevent such taller product containers from toppling forward out of the unit in a gravity feed situation, shelving units constructed according to the teachings of the present invention as well as prior art shelving units can also optionally include means for providing supplemental support to such taller product containers. As illustrated in FIGS. 6 and 7, such supplemental front wall product support means can include an additional elongated stop member 44 which is specifically designed for use in conjunction with the inverted arch front wall design associated with the shelf members illustrated in FIGS. 1 and 2, although the stop member 44 is likewise adaptable for use with other prior art units having front wall designs utilizing upstanding portions comparable to the upstanding leg portions of the inverted arches 28' such as, for example, a front wall design incorporating a plurality of U-shaped openings thereacross. More particularly, the stop member 44 includes arcuate portions 46 spaced in between relatively short straight portions 48 along its entire length as best shown in FIG. 6. The arcuate portions 46 are designed to conform somewhat with the shape of cylindrical soft drink containers while the straight portions 48 are positioned and located in spaced apart relationship so as to be receivably insertable into corresponding slots or grooves 50 formed in each respective end or crown portion 52 associated with each leg portion of each inverted arch as illustrated in FIG. 7. The stop member 44 can be permanently secured within each respective slot 50; it can be positioned within the respective slots so as to be removably engageable therewith; it can be retrofitted into existing units by modifying such units to include the slots or grooves 50 as shown in FIG. 7; or the stop member 44 can be integrally formed into newly fabricated units. The present front wall stop member 44 can also be made transparent so that its use will not interfere with or otherwise hinder or obstruct the visibility of product labeling. Use of the present stop member 44 provides additional front support, when needed, for holding and retaining taller products and for preventing such taller products from falling forward out of a particular unit, particularly in a gravity feed application. The present stop member 44 may likewise be adaptable for use with still other front wall configurations not specifically referenced herein so long as the stop portions 48 are attachable or otherwise engageable with certain portions of a particular front wall structure.

Thus, there has been shown and described a novel product merchandising display shelf construction including several embodiments of a novel product guide channel means for use in merchandising and storing shelved products, particularly products packaged in relatively tall product containers, which display shelf constructions fulfill all of the objects and advantages sought therefor. Many changes, modifications, variations, and other uses and applications of the present constructions will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A product display shelf structure for organizing and merchandising a plurality of products in parallel rows, said shelf structure comprising front, rear and opposed side edges and a floor portion extending therebetween, a plurality of divider walls extending from said front edge portion towards said rear edge portion having a top edge and dividing said floor portion into a plurality of parallel guide channels for maintaining and guiding products located therein, said divider walls being resilient and including means for allowing at least the upper portions of said divider walls to flex sidewardly along a substantial portion of the length thereof to prevent binding of such products as they move within said guide channels, said means for allowing at least the upper porions of said divider walls to flex sidewardly including a plurality of slots formed in said divided walls at spaced locations therealong, each of said slots extending beyond at least one half the height each divider wall from said top edge thereof and being spaced from said floor portion.

2. The product display shelf structure according to claim 1 wherein said plurality of slots are angularly oriented relative to said floor portion.

3. The product display shelf structure according to claim 1 wherein said plurality of slots define a plurality of segmented divider wall portions.

4. In a shelving unit for merchandising products arranged in rows having front, rear and opposed side walls and a floor portion extending therebetween, and spaced parallel upstanding walls extending upwardly from said floor portion from said front wall towards said rear wall defining therebetween a plurality of channels for receiving and supporting products positioned therewithin, the improvement comprising channel guide means associated respectively with one or more of said opposed side walls and said parallel upstanding walls fur providing sideward support for taller products positioned in said channels, each of said channel guide means being attachable to the respective side walls and spaced parallel upstanding walls of said shelving unit ..and each including segmented portions, each of said segmented portions being flexibly movable sidewardly to prevent binding of products located in said channels.

5. The shelving unit according to claim 4 wherein said channel guide means are integrally formed as part of the respective side walls and spaced parallel upstanding walls of said shelving unit.

6. The shelving unit according to claim 4 wherein said segmented portions are each separate members attachable to the respective side walls and/or spaced parallel upstanding walls of said shelving unit.

7. A shelving unit for merchandising products in parallel rows comprising a base member having spaced front and rear walls and a floor portion extending therebetween, spaced parallel divider walls having an upper edge and extending upwardly from said floor portion dividing said floor portion into a plurality of adjacent channels extending from said front wall towards said rear wall for receiving and supporting products positioned therewithin each of said divider walls having spaced slots formed along the length thereof between said front and rear walls, each of said slots extending to at least the upper edge of a respective divider wall so as to define a plurality of segmented portions along the length of said divider wall each of said slots extending beyond at least one half the height of said divider wall and being spaced from said floor portion each of said segmented portions being flexibly movable sidewardly independently of one another to prevent said divider walls from impeding the movement of products positioned within said channels.

8. The shelving unit according to claim 7 wherein said front wall includes a plurality of spaced upstanding front wall portions dividing said front wall into a plurality of spaced openings each corresponding in location to one of said plurality of product channels, and wherein each of said upstanding front wall portions includes a top portion, said shelving unit further including an elongated member having spaced arcuate portions associated therewith, said elongated member being cooperatively engageable with the top portion of at least some of said upstanding front wall portions such that said arcuate portions lie in registration with said plurality of front wall openings and provide support to the forwardmost products positioned in said product channels thereby preventing said products from falling through said front wall openings.

9. The shelving unit according to claim 8 wherein the top portion of at least some of said upstanding front wall portions include grooves formed therein for cooperatively receiving said elongated member.

10. The shelving unit according to claim 8 wherein the arcuate portions of said elongated member are shaped to conform to the shaped portions of certain products.

11. The shelving unit according to claim 8 wherein said elongated member is transparent.

12. A shelf member for organizing and merchandising a plurality of products in parallel rows, said shelf member comprising a base member having spaced front and rear walls and a floor portion extending therebetween, spaced upstanding walls extending upwardly from said floor portion dividing said floor portion into a plurality of adjacent channels extending from said front wall towards said rear wall for receiving and supporting products positioned therewithin, and guide members attachable to one or more of said upstanding walls, said guide members including segmented portions extending upwardly from said respective upstanding walls to provide support for taller products positioned in said channels, each of said segmented portions being sufficiently resilient so as to flex laterally relative to said channels to prevent said segmented portions from binding products positioned within said channels.

13. In a shelf member for merchandising products in parallel rows wherein said shelf member includes spaced front, rear and opposed side walls and a floor portion extending therebetween, said floor portion being divided into parallel adjacent channels extending from said front wall towards said rear wall for receiving and supporting products positioned therewithin, said front wall including a plurality of spaced openings corresponding in location with each of said parallel adjacent channels and defining therebetween upstanding front wall portions each having a top portion associated respectively therewith, the improvement comprising an elongated member having spaced arcuate portions associated therewith, said elongated member being attachable to the top portion of at least some of said upstanding front wall portions such that said arcuate portions span at least some of said front wall openings, said arcuate portions providing support to the forwardmost products located in those channels where said arcuate portions span said corresponding front wall openings so as to further prevent said forwardmost products from falling through said openings.

14. The shelving unit according to claim 13 wherein the top portion of at least some of said upstanding front wall portions include slots formed in at least a portion thereof for cooperatively receiving said elongated member.

15. The shelving unit according to claim 13 wherein the arcuate portions of said elongated member are shaped to correspond to the shaped portions of certain products.

16. The shelving unit according to claim 13 wherein said elongated member is transparent.

17. In a shelf member having spaced front, rear and opposed side walls and a floor portion extending therebetween, said floor portion being divided into parallel channels extending from said front wall towards said rear wall for receiving and supporting products positioned therewithin, said front wall having a plurality of spaced upstanding front wall portions defining therebetween a plurality of openings, the improvement comprising slot means formed in at least some of said upstanding front wall portions, and an elongated member cooperatively engageable with said slot means, said elongated member spanning said front wall openings to prevent products positioned adjacent thereto from falling through said front wall openings.

18. The shelving unit according to claim 17 wherein said elongated member includes spaced arcuate portions, each of said arcuate portions being located to span a particular front wall opening when said elongated member is engaged with said slot means.

* * * * *

UNITED STATES PATENT AND TRADEMARK OFFICE

CERTIFICATE OF CORRECTION

PATENT NO. : 5,351,838

DATED : October 4, 1994

INVENTOR(S) : Paul L. Flum

It is certified that error appears in the above-identified patent and that said Letters Patent is hereby corrected as shown below:

Column 3, line 35, after "plurality", insert --of--.

Column 7, line 53, "molested" should be --molded--.

Column 10, line 33, after " 37' ", insert --.--.

Column 12, line 14, "fur" should be --for--.

Column 12, line 18, "..and" should be --and--.

Signed and Sealed this

Thirteenth Day of December, 1994

*Attest:*

Bruce Lehman

BRUCE LEHMAN

*Attesting Officer*

*Commissioner of Patents and Trademarks*